United States Patent [19]

Mann

[11] Patent Number: 4,671,305

[45] Date of Patent: Jun. 9, 1987

[54] ARTIFICIAL FINGERNAIL TIP

[75] Inventor: Samuel J. Mann, Englewood, N.J.

[73] Assignee: Inverness Corporation, Fair Lawn, N.J.

[21] Appl. No.: 752,687

[22] Filed: Jul. 8, 1985

[51] Int. Cl.[4] ..... A45D 29/00

[52] U.S. Cl. ..... 132/73

[58] Field of Search ..... 132/73, 88.7, 88.5, 132/1 R

[56] References Cited

U.S. PATENT DOCUMENTS

| | | | |
|---|---|---|---|
| 2,816,555 | 12/1957 | Klump | 132/73 |
| 3,552,401 | 1/1971 | Michaelson et al. | 132/73 |
| 3,786,821 | 1/1974 | Noskin | 132/88.5 |
| 3,856,026 | 12/1974 | Gaydos | 132/73 |
| 4,007,748 | 2/1977 | Matranga et al. | 132/73 |
| 4,135,526 | 1/1979 | Matranga et al. | 132/73 |
| 4,157,095 | 6/1979 | Sweet | 132/73 |
| 4,249,551 | 2/1981 | Nordstrom | 132/73 |
| 4,299,243 | 11/1981 | Umstattd | 132/73 |
| 4,346,720 | 8/1982 | Hokama | 132/73 |
| 4,632,134 | 12/1986 | Reid | 132/73 |

FOREIGN PATENT DOCUMENTS

| | | | |
|---|---|---|---|
| 1072931 | 3/1954 | France | 132/73 |

*Primary Examiner*—Gene Mancene
*Assistant Examiner*—J. Hakomaki
*Attorney, Agent, or Firm*—Blum Kaplan

[57] ABSTRACT

An artificial fingernail tip which simplifies and shortens the time required for its application onto a natural fingernail is presented. The artificial nail tip is structurally reenforced by integrally forming a plastic sheet with a fabric during manufacture. A free end of the fabric forms a fabric skirt which skirt together with the part of the sheet that is integrated with the plastic sheet facilitates application of the artificial fingernail tip to a natural fingernail.

12 Claims, 4 Drawing Figures

ARTIFICIAL FINGERNAIL TIP

BACKGROUND OF THE INVENTION

This invention is directed to an artificial fingernail tip and, in particular, to an artificial fingernail construction which improves the connection of an artificial fingernail tip to a natural nail. In addition, this invention facilitates and shortens the application of the artificial fingernail tip onto the natural nail by making an immediate smooth and attractive connection requiring, at most, a minimum of filing.

Artificial fingernails have enjoyed popularity among women for many years. Women in the habit of nail biting find them beneficial since, in their synthetic plastic resin form, they serve as an enormous preventative. In addition, women with naturally long nails, or who experience difficulty in growing long nails, desire such products when a nail breaks, splits or cracks to guarantee a uniform appearance.

In the current art, two distinct application processes for applying artificial nail tips have been utilized. Nevertheless, both processes have been found to be less than completely satisfactory due, in large measure, to problems inherent in the construction of the nail tip.

In particular, a nail tip molded of plastic resin is glued to approximately one-third of a natural nail using a rapid set adhesive, primarily cyano acrylate. The tip is applied so that it extends to just short of the cuticle area. Accordingly, a difference in the thickness of the nail tip set on top of the natural nail causes a step to form which must be reduced or eliminated to provide an attractive appearance.

After the adhesive sets, in approximately 10 seconds, one of two procedures is followed, both of which include the step:

(1) A blend of acrylic powder and acrylic liquid is brushed on the entire surface between the cuticle and the free edge of the tip of the artificial nail, thereby creating a blending of the thick artificial nail tip to the natural nail, followed by extensive abrasive filing. This procedure is commonly known as nail sculpturing.

(2) A piece of fabric is cut and glued to the artificial nail tip and the natural nail to reenforce the artificial fingernail adhesion and durability. Additional coats of adhesive are put on top of the fabric to serve as a filler to blend the step and aid the connection. This is followed by extensive abrasive filing and adhesive (filler reapplication ) to blend all the disparate contours formed by the thickness of the artificial nail set on top of the natural nail. This procedure is more commonly known as nail wrapping. Nail wrapping represents an improvement over the nail sculpturing because the fabric reenforces the criticial stress point, generally allowing four to six weeks of wear.

Some of the problems associated with both of the conventional techniques discussed above include: Fungus growth due to the need for several thicknesses of acrylic filler or adhesive filler which inhibit the respiratory process; allergic toxicity due to breathing fumes from the use of acrylic filler and adhesives during the lengthy application period; and the time and expertise required to blend the nails with filler and repeated grinding of the disparate contours of the step into a smooth finish. Finally, extensive maintenance is required as the nail grows because the thickness of both acrylic and adhesive filler at the cuticle must be filed down and filled again as the natural nail growth moves the applied tip away from the cuticle resulting in a pronounced step.

SUMMARY OF THE INVENTION

In accordance with the invention an artificial nail tip is provided. A synthetic sheet is molded into a fabric piece to provide a forward and longitudinal extension of the natural fingernail when attached. The fabric piece extends beyond the proximal edge of the synthetic sheet to form a fabric skirt unsupported by the sheet. The fabric skirt, combined with adhesive, is the means of attachment to the natural nail. The synthetic sheet includes a molded step which abuts against the foremost edge of the natural nail, setting and aligning it in a fixed position. Because the synthetic sheet tapers to an extremely small thickness, approximately the same as that of the fabric skirt, it allows for an immediate smooth application to the natural nail.

The fabric piece is molded into the synthetic sheet when the artificial tip is manufactured so that the fabric piece is impregnated into the plastic sheet. This integration of the plastic sheet and fabric piece contributes to increased structural reenforcement of the artificial nail tip and to its attachment to the natural nail. By reason of its construction a slight amount of buffing of the fabric skirt on the natural nail may be necessary after the tip is adhesively secured to a natural fingernail.

Accordingly, it is an object of this invention to provide an attractive artificial nail tip construction requiring at most a minimum of filing and finishing to apply to a natural fingernail.

Another object of the instant invention is to provide an artificial nail tip wherein the step formed by the thick nail tip set on top of the natural nail is substantially reduced so that the need to smooth out the step is substantially eliminated.

Another object of the invention is to reduce the amount of adhesive required to adhere and finish an artificial nail tip to a natural fingernail so as to improve nail respiration.

Still a further object of the invention is to provide an artificial fingernail tip that eliminates excessive gluing and filing steps.

Another object of the instant invention is to provide an artificial fingernail tip construction which requires little maintenance as the natural nail begins to grow.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scpe of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
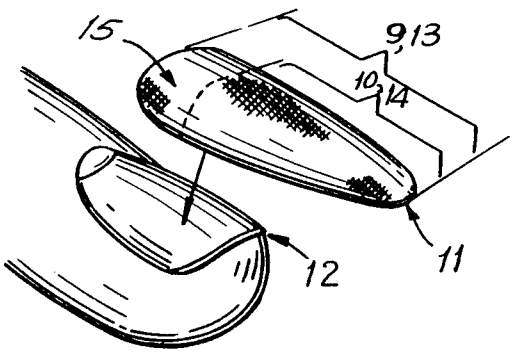
FIG. 1 is a perspective view of an artificial fingernail tip constructed in accordance with a preferred embodiment of the instant invention.
Figure 2:
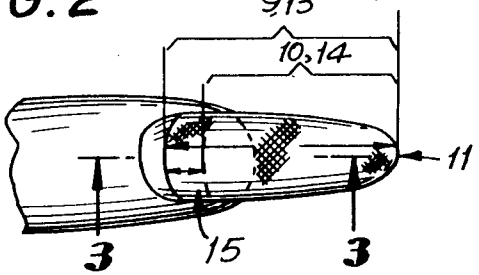
FIG. 2 is an elevational view showing the artificial fingernail construction after application to the natural fingernail.
Figure 4:
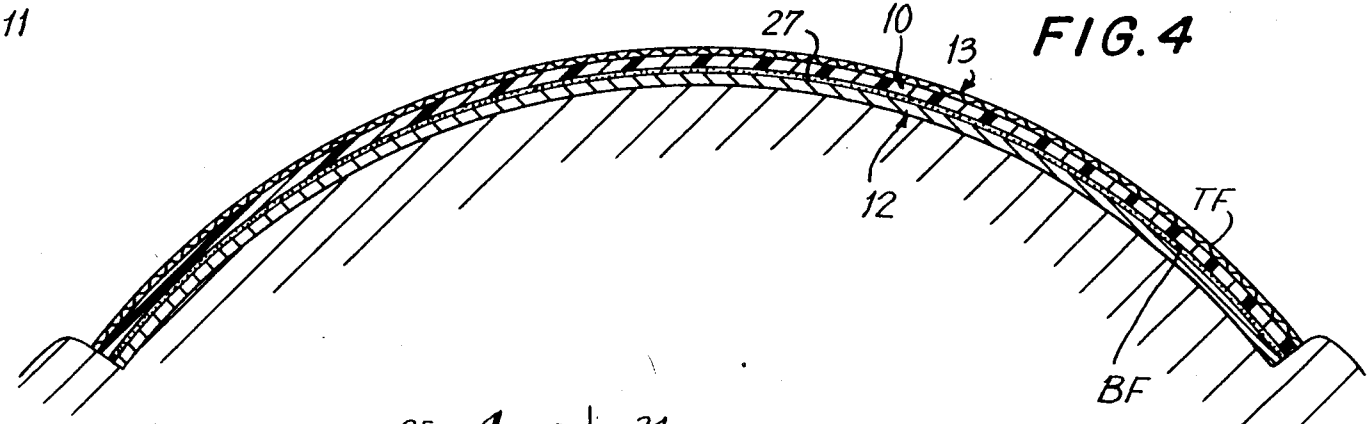
FIG. 4 is a partial sectional view, taken along line 4—4 of FIG. 3.
Figure 3:
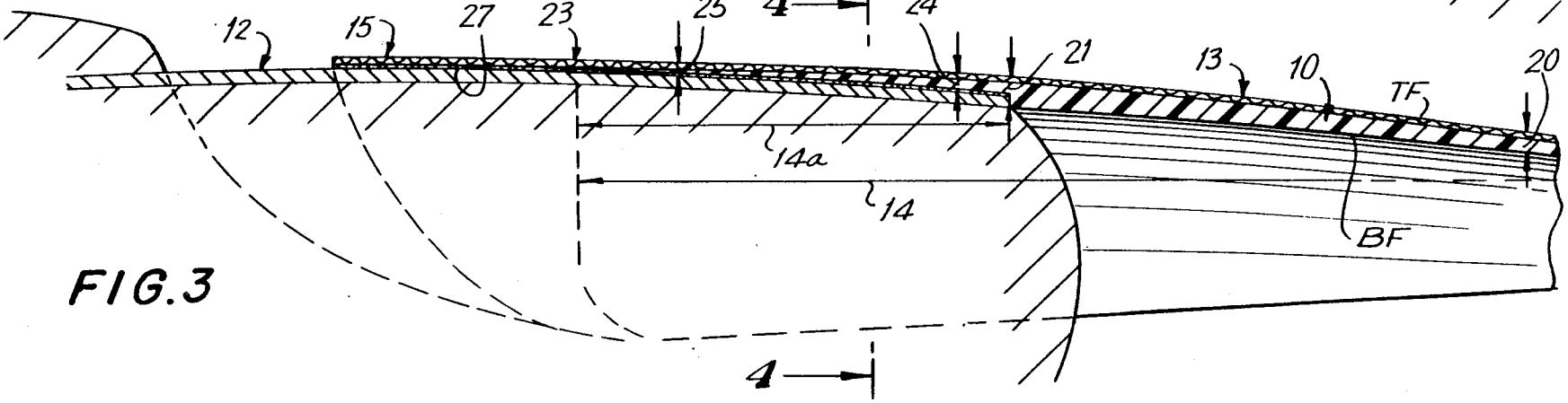
FIG. 3 is a sectional view of the artificial fingernail tip, at an enlarged scale, taken along line 3—3 of FIG. 2.

Referring to FIGS. 1 through 4, an artificial fingernail tip, indicated generally as 9, is depicted. Artificial fingernail tip 9 includes a sheet 10 of a synthetic material such as plastic resin. Sheet 10 is molded into a fabric piece 13 so that a one-piece integral structure, comprised of the plastic sheet 10 and the fabric piece 13, is formed. In an exemplary embodiment, the one-piece integral structure includes an integration zone 14 extending from the forward or distal extension 11 to the proximal end of the plastic sheet and is formed by the area in which the sheet 10 is molded into the fabric piece 13. A fabric skirt 15 is formed by the non-overlapping area in which the fabric piece extends proximally from sheet 10 and in non-overlapping relationship therewith.

Distal extension 11 may or may not be part of the integration zone 14. Because of this, the one-piece integral structure has two possible embodiments. In a first exemplary embodiment, a forward extension 11 is formed of sheet 10 and fabric piece 13, in which case the distal extension 11 is part of the integration zone 14. In a second embodiment, a distal extension 11 is formed only of the sheet of synthetic material, in which case, the distal extension 11 is not part of integration zone 14.

Sheet 10 is molded into the fabric piece 13 to provide the distal extenson 11 of the natural fingernail 12 when attached. Sheet 10 has a first substantially uniform thickness, indicated at 20, throughout the length of the distal extension 11. A molded step 21 is formed by the reduced thickness, indicated at 24, in the integration zone 14. As the integration zone extends from step 21 to skirt 15, the thickness of the sheet continues to taper until it reaches position 23, where sheet 10 has been completely feathered leaving only the fabric skirt 15. Fabric skirt 15 begins at position 23 and is unsupported by sheet 10.

Integration zone 14 is formed of an impregnated fabric-synthetic material which contributes to increased structural reenforcement for the artificial nail and its attachment to natural fingernail 12. The integration zone 14 has a subpart, transitional section 14*a*, at its proximal end in which the fabric piece 13 is on the top face (TF) of the sheet 10. This allows for a smooth and permanent join of the artificial nail tip 9 to the natural fingernail. The remaining part of the integration zone 14 has the fabric piece 13 integrated with the sheet 10. At the position where sheet 10 has a small thickness 25, combined with the fabric piece 13, it defines the proximal end of the integration zone 14 and its subpart, the smaller transitional section 14*a*. The molding of the sheet to the fabric creates a smooth and attractive finish as formed.

In a preferred embodiment the distal extension 11 is on the order of 0.020 inches thick, the integration zone thickness is at or about 0.008 inches at the stepdown and feathers to a thickness on the order of approximately 0.001 to 0.004 inches at its proximal end, where the attached fabric skirt is the same thickness.

In operation a thin film of an adhesive 27, such as cyano acrylate, is applied to the natural fingernail. Thereafter, the artificial nail tip is pressed onto the natural fingernail so that the fabric skirt and integrated zone of the fingernail tip are bonded by the adhesive to the natural fingernail. An additional coat of adhesive may be added on top of the fabric skirt as a final blending step. By using a thin film of adhesive 27 applied to the natural fingernail, an immediate smooth and strong bonding connection between the artificial fingernail (skirt and integrated zone) is created. Because minimum filing may be required, a distinct procedural step required in conventional techniques, such as nail wrapping and nail sculpting, is avoided. Futhermore, by using the artificial fingernail tips of the instant invention, longlasting wear is obtained due to stronger adhesion to the natural nail.

A benefit of the instant invention results from the natural respiration of the natural fingernail through the thin adhesive film and fabric skirt, which respiration prevents against the growth of fungus. A further benefit obtained by the artificial fingernail tip of the instant invention is the immediate smooth application to the natural fingernail caused by the configuration of the fabric skirt and the thin synthetic sheet. In particular, the sheet used to form the artificial fingernail is molded to a minimum thickness that approaches the thickness of a natural fingernail, before further tapering down to imperceptably no thickness, at which point the fabric skirt is unsupported by the sheet.

The strength of the integration zone is particularly achieved by the method of molding the artificial fingernail tip and the material used therein. Specifically, a fabric piece is clamped across an open mold so that it is held taut. Next, the mold is closed over the taut fabric piece to secure the fabric within the mold. Uncured plastic (cellulose acetate butyrate) is then injected into the mold from a location under said taut fabric piece so that the fabric piece is impregnated in the area that is overlapped in the mold to form the integration zone and, hence, the artificial fingernail tip. Although the use of linen and silk to form the fabric skirt have been contemplated, in an exemplary embodiment, a polyester fabric has been found to be best suited to the instant invention. In particular, it has been found that polyester fabrics have a sufficiently tight weave to insure that the fabric is pressed against the top of the mold during the molding process. This assumes that a smooth finish occurs. Polyester fabrics are also sufficiently porous to permit the fabric to be impregnated with the resin so that the fabric and resin are integrated into a one piece construction that is both durable and strong.

A further step in the process of manufacturing artificial fingernail tips is the use of a heating dye for stamping the dorsal end of the nail after it is removed from the mold. By using a pair of heated platens, the nail is sized, shaped and trimmed to eliminate stray fibers. Specifically, when the nail tips are removed from the molds, the stray threads remain. Also, the thickness of the nails and fabric at or about the position where the plastic feathers away leaving only the fabric skirt, is on the order of 0.004 to 0.008 inches. However, after sandwiching the proximal end of the nail tips between the platens, the thickness of the skirt is reduced down to a thickness on the order of 0.001 inches to 0.004 inches.

Moreover, the heated platens cause the edges to be fused thereby eliminating stray fibers.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An artificial fingernail tip adapted to be secured to a natural fingernail comprising: a substantially rigid sheet formed to provide a proximal extension and distal extension to a natural fingernail; a fabric piece of predetermined size integrally formed within said sheet, a portion of said fabric piece being non-coextensive with said sheet to define a fabric skirt, the remaining portion of said fabric skirt overlapping at least a part of said sheet to define an integration zone whereby the skirt and at least a part of said integration zone are adapted to be secured to a natural fingernail.

2. An artificial fingernail tip, as claimed in claim 1, wherein said sheet is a synthetic material.

3. An artificial fingernail tip, as claimed in claim 1, wherein said fabric piece is of sufficient woven characteristics to permit the synthetic material to be impregnated therein during molding.

4. An artificial fingernail tip, as claimed in claim 3, wherein said fabric piece is polyester fabric.

5. An artificial fingernail tip, as claimed in claim 1, wherein the integration zone contains a transitional section at the proximal end of said sheet having the fabric piece as a top face, adjacent to the remaining part of the integration zone wherein the fabric piece is integrally formed with said sheet.

6. An artificial fingernail tip, as claimed in claim 1, wherein said fabric skirt is unsupported by said sheet.

7. An artificial fingernail tip, as claimed in claim 5, wherein said sheet has a predetermined distal extension thickness, a step to an intermediate thickness, and a further feathering to an imperceptably measurable thickness at the proximal end of said sheet.

8. An artificial fingernail tip, as claimed in claim 1, wherein said sheet has said distal extension thickness of 0.020 inches, said step down to an intermediate thickness on the order of no more than 0.008 inches, and a further feathering down at the proximal end of the sheet to a thinness on the order of 0.001 to 0.004 inches.

9. An artificial fingernail tip, as claimed in claim 5, wherein said edge of said fabric skirt feathers to a thickness on the order of 0.001 to 0.004 inches.

10. A method of forming an artificial fingernail including the steps of clamping a fabric piece across an open mold to hold it taut, closing the mold and injecting a moldable material into the mold to form the sheet from a location underneath the fabric piece thereby impregnating a portion of the fabric piece to integrally embed said fabric in a portion of said sheet so as to form an integration portion having the fabric embedded in the sheet.

11. A method, as claimed in claim 10, wherein said fabric admits of a woven quality that causes it to be forced against the upper surface of said mold when the moldable material is injection molded underneath the fabric.

12. A method of forming an artificial nail, as claimed in claim 10, including the step of stamping the proximal ends of said tips between heated platens after molding whereby said fabric skirt is reduced in thickness and is formed and finished.

* * * * *